US005716099A

United States Patent [19]

McDiarmid

[11] Patent Number: 5,716,099

[45] Date of Patent: Feb. 10, 1998

[54] CHAIR WITH SPLIT RECLINING SEAT

[75] Inventor: Ronald D. McDiarmid, La Habra Heights, Calif.

[73] Assignee: Novimex Fashion Ltd., City of Industry, Calif.

[21] Appl. No.: 698,267

[22] Filed: Aug. 14, 1996

[51] Int. Cl.[6] ..... A47C 3/00

[52] U.S. Cl. ..... 297/302.1; 297/284.11

[58] Field of Search ..... 297/302.1, 284.11, 297/325–327, 312, 313, 316, 284.1

[56] References Cited

U.S. PATENT DOCUMENTS

| | | | |
|---|---|---|---|
| 1,836,630 | 12/1931 | Thum . | |
| 3,446,532 | 5/1969 | Cramer . | |
| 3,712,666 | 1/1973 | Stoll . | |
| 3,883,173 | 5/1975 | Shepard . | |
| 4,380,352 | 4/1983 | Diffrient | 297/302.1 X |
| 4,498,702 | 2/1985 | Raftery . | |
| 4,641,885 | 2/1987 | Braüning | 297/302.1 X |
| 4,765,679 | 8/1988 | Lanuzzi et al. . | |
| 4,979,778 | 12/1990 | Shields . | |
| 5,009,466 | 4/1991 | Perry . | |
| 5,352,022 | 10/1994 | Knoblock . | |
| 5,380,063 | 1/1995 | Dauphin . | |
| 5,401,077 | 3/1995 | Hosoe . | |
| 5,588,708 | 12/1996 | Rykken et al. | 297/284.11 X |
| 5,607,204 | 3/1997 | Gryp | 297/284.11 |

FOREIGN PATENT DOCUMENTS

| | | | |
|---|---|---|---|
| 800488 | 12/1950 | Germany | 297/284.11 |

*Primary Examiner*—Milton Nelson, Jr.

*Attorney, Agent, or Firm*—Keith A. Newburry; Sheppard, Mullin, Richter & Hampton LLP

[57] ABSTRACT

A chair with a split seat that allows the user to comfortably position his or her feet on the floor when the seat and seat back assume a partially reclined position. The chair has a base, a seat and a cooperating bracket and arm. The seat has a central portion and a forward portion. The central portion is pivotally mounted to the base for pivoting about a first axis and the forward portion of the seat is pivotally mounted to the central portion of the seat for pivoting about a second axis that is generally parallel to the first axis. The arm is fixedly mounted to the base and has a free end located in a fixed position with respect to the support. The bracket is mounted on the forward portion of the seat and is configured to slidably engage the free end of the arm to pivot the forward portion of the seat as the central portion of the seat pivots.

10 Claims, 3 Drawing Sheets

FIG. 1
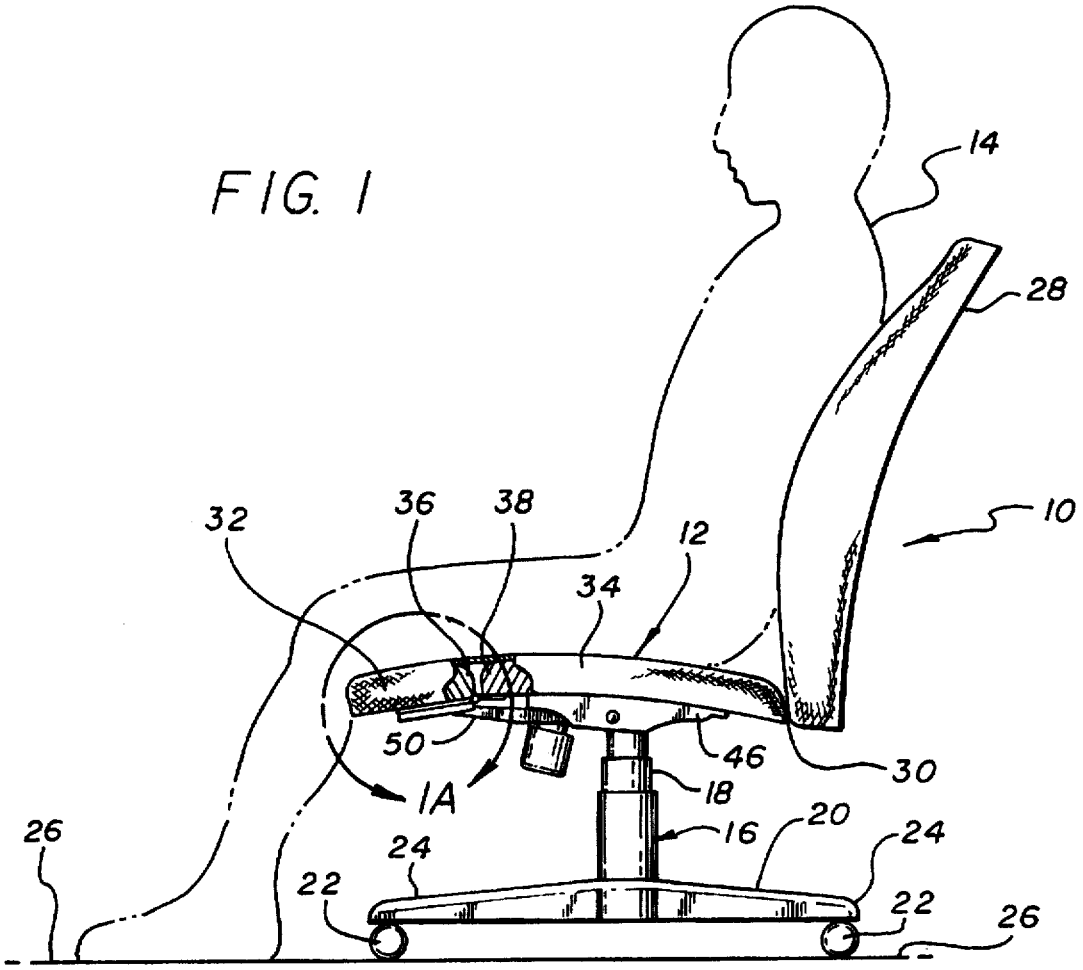
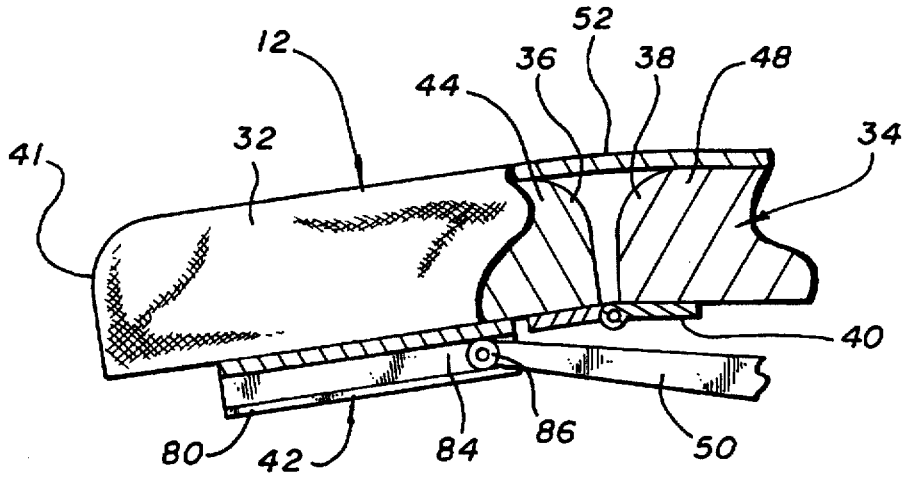
FIG. 1A

CHAIR WITH SPLIT RECLINING SEAT

FIELD OF THE INVENTION

The invention relates generally to chairs and, more particularly, to office type chairs that pivot rearwardly.

BACKGROUND OF THE INVENTION

Chairs of this particular type typically have a base with horizontal legs extending radially outward from a vertical support. A caster is mounted at the end of each leg allow the chair to be moved easily about a floor. A seat plate is mounted to the top of the vertical support and a seat is mounted to the seat plate. A seat back is mounted adjacent to the seat to support the back of the seated person. The seat plate can include a mechanism to allow the seat to selectively pivot rearwardly with respect to the base, thereby allowing the user to assume a partially reclined position.

Office chairs designed according to the prior art are generally comfortable. Because of cost and productivity concerns, office chairs with mechanisms that allow the user to recline the chair into a fully horizontal position are not desirable. However, during those times of the workday when the user does partially recline the chair, the seat may interfere with the comfortable positioning of the user's feet and legs. In particular, because the seat remains in a position generally perpendicular to the seat back, the user's feet can be moved toward the base of the chair and can even be lifted off of the floor as the seat is partially reclined. Accordingly, one drawback of conventional office chairs is that the user can be uncomfortable because of the position of his or her legs and feet when the seat is in a reclined position. Further, in this reclined position, the base of the chair also can interfere with the comfortable placement of the user's feet.

Accordingly, there has existed a definite need for a chair with a seat that allows the user to comfortably position his or her feet on the floor when the seat and seat back assume a partially reclined position. The present invention satisfies this need and provides further related advantages.

SUMMARY OF THE INVENTION

The present invention is embodied in a chair with a split seat that allows the user to comfortably position his or her feet on the floor when the seat and seat back assume a partially reclined position. More particularly, the present invention is embodied in a chair comprising a base, a seat and a cooperating bracket and arm. The base has an upwardly projecting support, and the seat has a central portion and a forward portion. The central portion is pivotally mounted to the support of the base for pivoting about a first predetermined axis and the forward portion is pivotally mounted to the central portion of the seat for pivoting about a second predetermined axis that is generally parallel to the first axis.

The arm is fixedly mounted to the support of the base and has a free end located in a fixed position with respect to the support. The bracket is mounted on the forward portion of the seat and is configured to slidably engage the free end of the arm to pivot the forward portion of the seat as the central portion of the seat pivots.

One advantage associated with the invention is that the orientation of the forward seat portion advantageously changes from a generally horizontal position to a sloped position to comfortably accommodate the user's legs as the seat reclines.

Other features and advantages of the present invention shall become apparent from the following description of the preferred embodiment, taken in conjunction with the accompanying drawings, which illustrate, by way of example, the principles of the invention.

BRIEF DESCRIPTION OF THE DRAWINGS

The following drawings illustrate the preferred embodiment of the invention. In such drawings:

FIG. 1 is an elevational view, shown in partial cross section, of a chair with a reclining seat in an upright position;

FIG. 1A is a detailed view of the chair of FIG. 1, taken about line 1A;

DESCRIPTION OF THE PREFERRED EMBODIMENT

Figure 2:
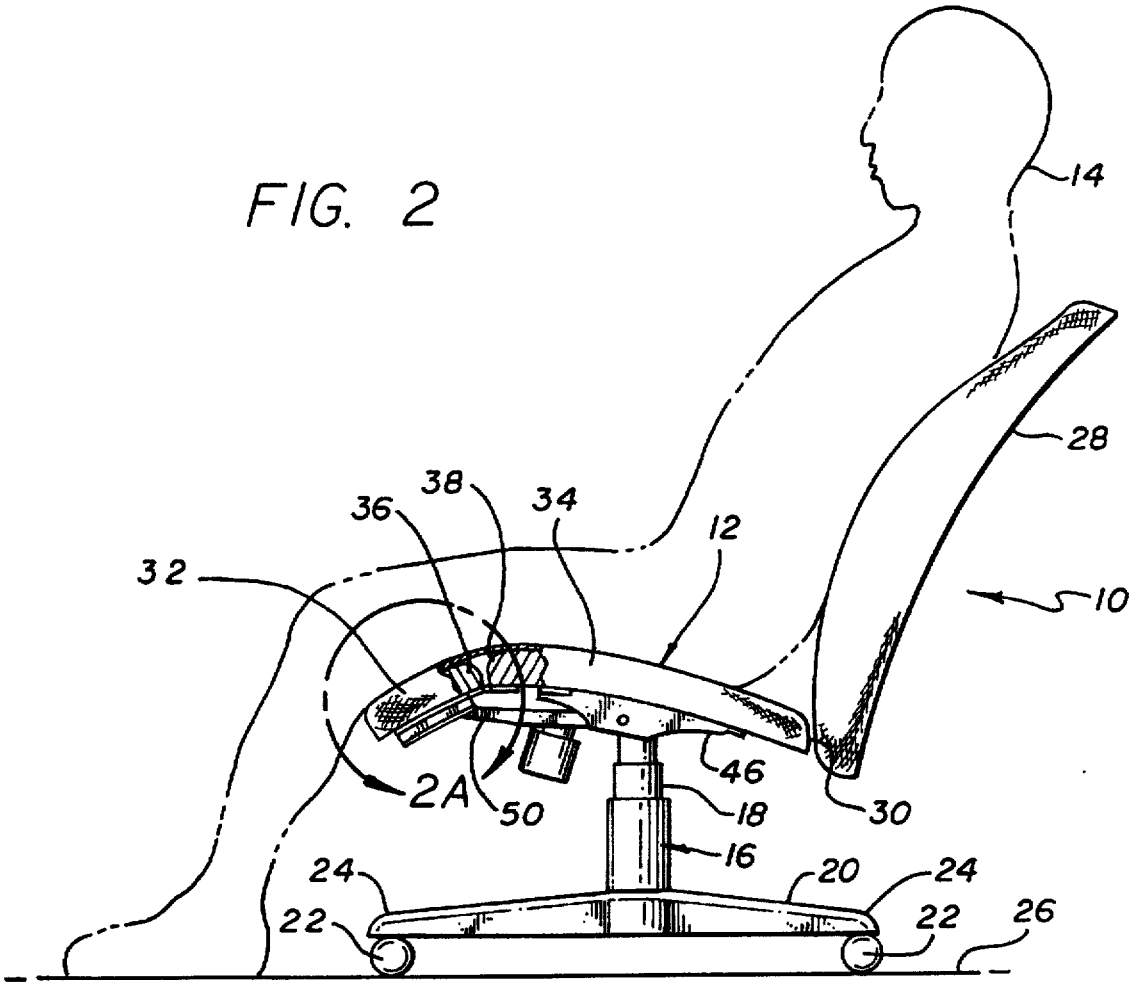
FIG. 2 is an elevational view, shown in partial cross section, of the chair of FIG. 1 in a reclined position.
Figure 2A:
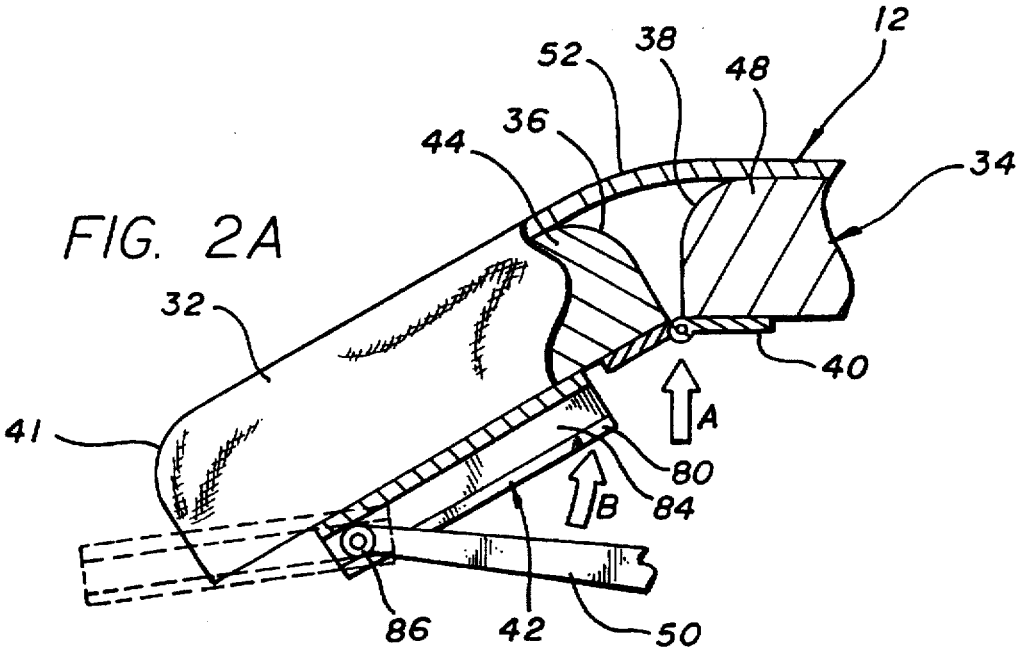
FIG. 2A is a detailed view of the chair of FIG. 2, taken about line 2A.

As shown in the exemplary drawings, and particularly in FIGS. 1 and 2, the present invention is embodied in a chair 10 with a split reclining seat assembly 12 for receiving a seated user 14. The chair has a seat assembly 12 pivotally mounted to a base 16 having a support 18 extending upwardly from a plurality of horizontal legs 20. Casters 22 are mounted on the ends 24 of the legs, to allow the user to roll the chair along a floor surface 26 as needed in the daily use of the chair for particular tasks. A back support 28 is mounted to the rear edge 30 of the seat assembly. As is well known in the art, the back support is sized and shaped to support the back of the user sitting in the chair.

The seat assembly 12 includes a forward portion 32 and a central portion 34 having opposing edges 36 and 38 joined by a hinge 40. Each side of the hinge is mounted to its associated seat portion by screws or other suitable fasteners. The forward portion of the seat assembly has a forward edge 41, and it includes a bracket 42 mounted underneath a seat cushion 44. The central portion of the seat assembly includes a seat plate 46 mounted underneath another seat cushion 48. An arm 50 is mounted upon the support 18 of the base 16 and projects forwardly to slidably engage the bracket 42 mounted underneath the forward portion of the seat assembly, as discussed in more detail below.

The cushions 42 and 44 of the respective forward and central portions 32 and 34 of the seat assembly 12 are made of foam-rubber mounted over plywood, as is well known in the art. The cushions have an outer covering 52 made of fabric, leather or any other suitable material. This outer covering is wrapped around the forward and central portions of the seat assembly to give the chair 10 an appealing appearance and to otherwise prevent objects from interfering with the movement of the seat portions. Other well known materials can be used to make the cushions, as required by particular applications.

Figure 3:
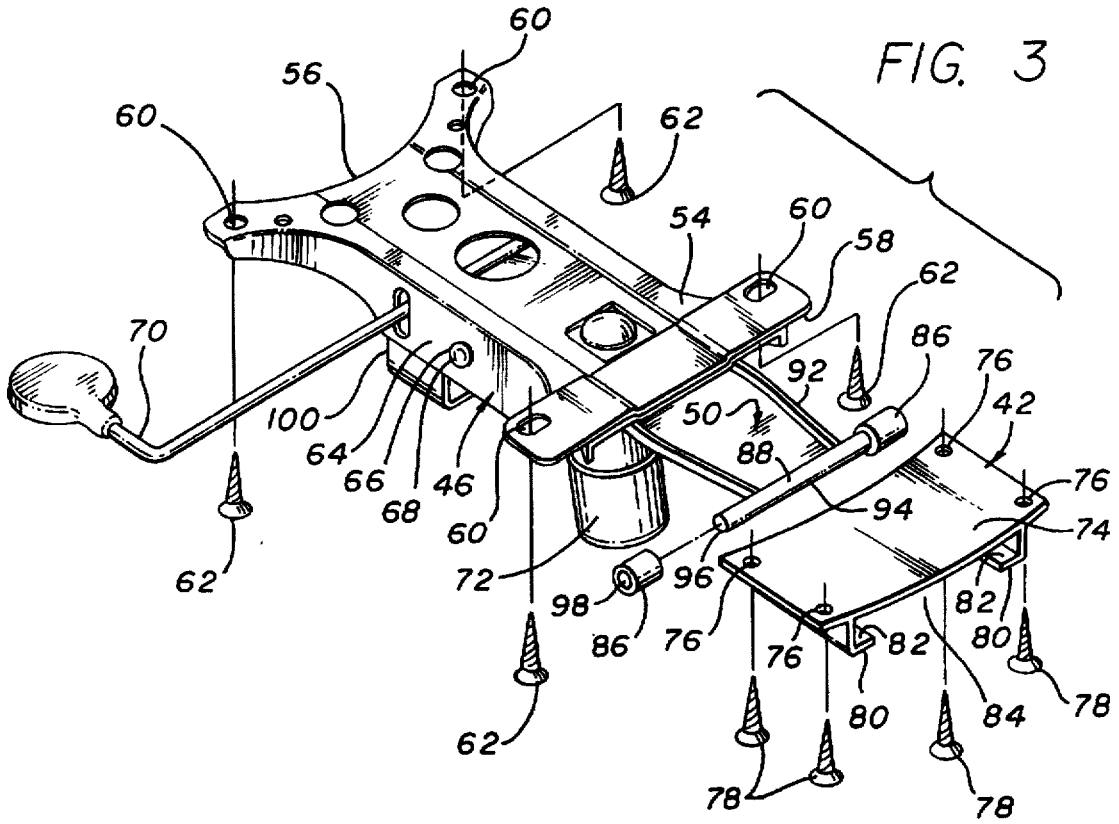
FIG. 3 is a perspective view of a seat plate and an associated bracket from the chair of FIG. 1.
Figure 4:
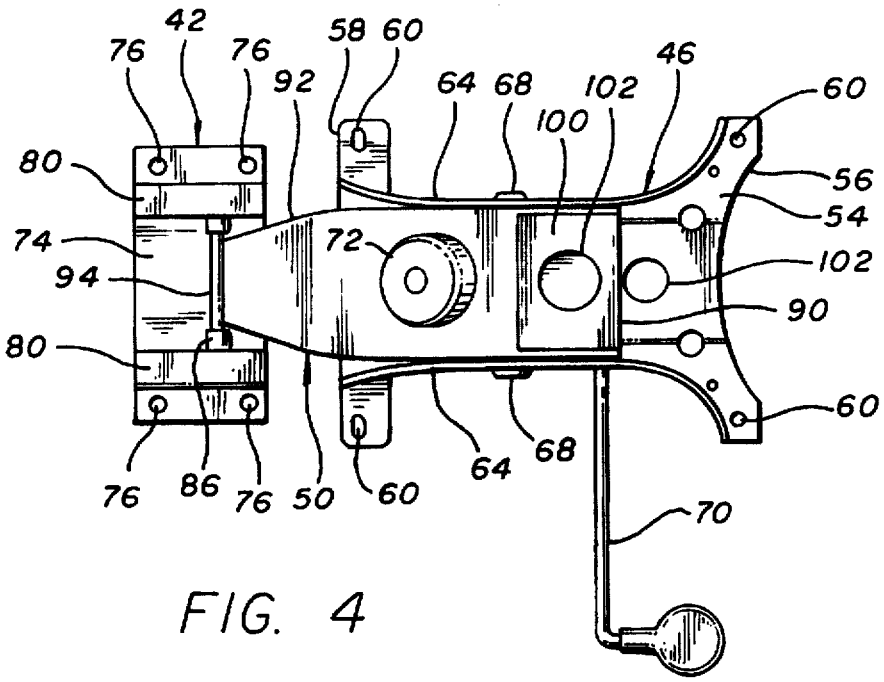
FIG. 4 is a bottom plan view of the seat plate and bracket of FIG. 3.

The seat plate 46 and the bracket 42 are shown in more detail in FIGS. 3 and 4. The seat plate has an upper wall 54 with two ends 56 and 58. Two opposing mounting holes 60 are located in each end of the seat plate. The holes are sized to provide for attachment of the seat plate to the bottom of the central portion 34 of the seat assembly 12 via mounting screws 62 or other suitable fasteners. The seat plate also has two opposing side flanges 64 that project downwardly from the sides of the upper wall. Horizontally aligned holes 66 are located in the side flanges of the seat plate to accept pivot pin 68 to pivotally mount the seat plate to the arm 50.

The seat plate 46 also can include a tilt adjustment lever mechanism 70 and a spring mechanism 72 which are commonly available on chairs designed for use in an office environment. The spring mechanism biases the seat toward an upright position.

The bracket 42 is mounted under the forward portion 32 of the seat assembly 12, and it has a rectangular upper wall 74 with mounting holes 76 adjacent to each of its corners. The upper wall of the bracket is slightly curved to accommodate the forward portion of the seat assembly, which is curved in a like manner for user comfort. Mounting screws 78 or other suitable fasteners hold the bracket to the underside of the forward portion of the seat assembly. Two opposing L-shaped walls 80 project downwardly from the upper wall of the bracket so that their facing surfaces 82 define a longitudinal channel 84 sized to accept arm rollers 86 therein, as described below.

The arm 50 has a forward end 88, a rearward end 90, and a body 92 therebetween. The rollers 86 are mounted upon a rod-shaped guide 94 that is welded to the forward end of the arm. The guide has two ends 96 spaced apart a distance sufficient to allow the guide to fit within the channel 84 of the bracket 42. The rollers each have an interior surface defining a throughhole 98 sized to fit over the ends of the guide, to facilitate the movement of the bracket with respect to the arm. The rollers can be made of nylon plastic or any other suitable material. The body of the arm has a transverse central hole therein located to align with the holes in the side flanges 64 of the seat plate 46 to receive the pivot pin 68 therein.

A U-shaped bracket 100 is mounted to the rearward end 90 of the arm 50. Specifically, the upper edges of the U-shaped bracket are welded to the rearward end of the arm. The bottom of the U-shaped bracket has a hole 102 sized to accept the support 18 of the base 16 therein. The bottom of the U-shaped bracket is fastened to the support by way of welding or any other suitable fastener.

The arm 50, the guide 94, the bracket 42 mounted upon the forward seat portion 32, the U-shaped bracket 100 and the seat plate 46 can be made of any metal of suitable strength that can be joined by welding. The aforementioned components can be formed by various well known manufacturing methods, such as by stamping.

With reference to FIGS. 1, 1A, 2, and 2A, the use of the chair 10 and the automatic movement of the forward portion 32 of the seat 12 to enhance the comfort of the user 14 will now be described. The seat of the chair, like those of other office chairs, selectively pivots between an upright position (see FIG. 1) and a reclined position (see FIG. 2). In the upright position, the rollers 86 on the guide 94 of the arm 50 are located toward the rearward end of the channel 84 formed by the L-shaped walls 80 of the bracket 42 mounted on the underside of the forward seat portion. As the user reclines the seat, the forward edge 38 of the central portion 34 of the seat assembly pivots upwardly, thereby moving the adjacent edge 36 of the forward seat portion upwardly in the direction of arrow A.

Keeping in mind that a hinge 40 connects the forward seat portion 32 to the central seat portion 34, the upward movement of the forward seat portion causes the bracket 42 to move upward with respect to the arm 50, which is stationary. Thus, when the seat 12 reaches the reclined position, the bracket has moved upwardly in the direction of arrow B and has moved across the rollers 86 so that the rollers occupy the forward end of the channel 84 in the bracket. In this regard, the dotted lines in FIG. 2A indicate the position of the bracket when the seat is in an upright position. During this movement, the orientation of the forward seat portion has advantageously changed from a generally horizontal position to a sloped position, to comfortably accommodate the user's 14 legs. In particular, the forward edge 41 of the forward seat portion is oriented in a position that is lower than the now-raised rearward edge 36 of that seat portion. Thus, the front edge of the seat assembly does not pivot upward and cause the user's legs to uncomfortably elevate from the floor surface 26.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A chair comprising:

a base having an upwardly projecting support;

a seat having a central portion and a forward portion, the central portion pivotally mounted to the support of the base for pivoting about a first predetermined axis, the forward portion pivotally mounted to the central portion of the seat for pivoting about a second predetermined axis generally parallel to the first axis;

an arm fixedly mounted to the support of the base, the arm having a free end located in a fixed position with respect to the support; and a bracket mounted on the forward portion of the seat, the bracket configured to slidably engage the free end of the arm to pivot the forward portion of the seat as the central portion of the seat pivots.

2. The chair of claim 1, wherein the arm is generally horizontal and includes a rod-like guide at its free end, the guide having two ends sized to slidably engage the bracket.

3. The chair of claim 2, wherein the bracket has opposing walls defining a channel sized to accept the guide therein.

4. The chair of claim 2, wherein the guide includes a roller mounted to each end of the guide.

5. The chair of claim 1, wherein the seat further includes a hinge that pivotally joins the forward portion to the central portion.

6. A chair comprising:

a base having an upwardly projecting support;

a seat having a central portion and a forward portion, the central portion pivotally mounted to the support of the base for pivoting about a first predetermined axis, the forward portion pivotally mounted to the central portion of the seat for pivoting about a second predetermined axis generally parallel to the first axis;

an arm fixedly mounted to the support of the base, the arm having a rod-shaped guide located in a fixed position with respect to the support; and a bracket mounted on the forward portion of the seat, the bracket having an interior surface defining a channel sized to slidably engage the rod-shaped guide of the arm to pivot the forward portion of the seat as the central portion of the seat pivots.

7. The chair of claim 6, wherein the rod-shaped guide has two ends sized to engage the channel of the bracket.

8. The chair of claim 7, wherein the rod-shaped guide includes two opposing rollers, each roller mounted to an associated end of the rod-shaped guide.

9. The chair of claim 6, wherein the seat further includes a hinge that pivotally joins the forward portion to the central portion.

10. A chair comprising:

a base having a support extending upwardly from a plurality of generally horizontally extending legs;

a seat having a central portion and a forward portion, the central portion pivotally mounted to the support of the base for pivoting about a first predetermined axis, the forward portion pivotally mounted to the central portion of the seat for pivoting about a second predetermined axis generally parallel to the first axis;

a generally horizontal arm fixedly mounted to the support of the base, the arm having a free end located in a fixed position with respect to the support;

a rod-shaped guide mounted on the free end of the arm, the guide having two opposed ends spaced apart a predetermined distance;

two rollers, each mounted about one associated end of the rod-shaped guide on the free end of the arm;

a bracket mounted on the forward portion of the seat, the bracket having a back wall between two opposing L-shaped walls, the L-shaped walls spaced apart to slidably receive therein the rollers on the guide to pivot the forward portion of the seat as the central portion of the seat pivots.

* * * * *